US010573977B2

(12) United States Patent
Onuma

(10) Patent No.: US 10,573,977 B2
(45) Date of Patent: Feb. 25, 2020

(54) TERMINAL-EQUIPPED ELECTRIC WIRE

(71) Applicant: Yazaki Corporation, Minato-ku, Tokyo (JP)

(72) Inventor: Masanori Onuma, Makinohara (JP)

(73) Assignee: Yazaki Corporation, Minato-ku, Tokyo (JP)

( * ) Notice: Subject to any disclaimer, the term of this patent is extended or adjusted under 35 U.S.C. 154(b) by 0 days.

(21) Appl. No.: 16/253,844

(22) Filed: Jan. 22, 2019

(65) Prior Publication Data

US 2019/0229437 A1 Jul. 25, 2019

(30) Foreign Application Priority Data

Jan. 24, 2018 (JP) ..... 2018-009948

(51) Int. Cl.

| | |
|---|---|
| ***H01R 4/10*** | (2006.01) |
| ***H01R 4/18*** | (2006.01) |
| ***H01R 13/03*** | (2006.01) |
| ***C22C 21/00*** | (2006.01) |
| ***H01R 43/04*** | (2006.01) |
| ***H01R 43/24*** | (2006.01) |
| ***H01R 4/70*** | (2006.01) |
| ***H01R 13/52*** | (2006.01) |
| *H01R 4/62* | (2006.01) |

(52) U.S. Cl.

CPC ..... *H01R 4/184* (2013.01); *C22C 21/00* (2013.01); *H01R 4/70* (2013.01); *H01R 13/03* (2013.01); *H01R 13/52* (2013.01); *H01R 43/04* (2013.01); *H01R 43/24* (2013.01); *H01R 4/62* (2013.01)

(58) Field of Classification Search

CPC . H01R 4/184; H01R 4/70; H01R 4/62; H01R 13/03; H01R 13/52; H01R 43/04; H01R 43/24

USPC ..... 439/877–882, 936

See application file for complete search history.

(56) References Cited

U.S. PATENT DOCUMENTS

| | | | | |
|---|---|---|---|---|
| 2,901,722 | A * | 8/1959 | Arnott, Jr. | H01R 4/62 439/203 |
| 5,418,331 | A * | 5/1995 | Delalle | H01R 4/22 174/74 R |
| 7,174,633 | B2 * | 2/2007 | Onuma | H01R 4/04 29/854 |
| 8,079,870 | B2 * | 12/2011 | Nakamura | H01R 9/0518 439/585 |
| 2016/0134028 | A1 * | 5/2016 | Kondo | H01R 4/70 439/877 |

FOREIGN PATENT DOCUMENTS

| | | |
|---|---|---|
| JP | 2010-108828 A | 5/2010 |
| JP | 2016-181387 A | 10/2016 |

* cited by examiner

*Primary Examiner* — Khiem M Nguyen
(74) *Attorney, Agent, or Firm* — Banner & Witcoff, Ltd.

(57) ABSTRACT

A terminal-equipped electric wire includes: an electric wire including a core wire covered with a coating; and a terminal fitting connected to an end portion of the electric wire in which the core wire is exposed. The terminal fitting includes: a core wire crimp portion crimped to the core wire; a coating fixing portion surrounding the coating with a gap; and a joint portion provided between the core wire crimp portion and the coating fixing portion. The joint portion is sealed by a resin filled to surround an entire circumference of the core wire in the joint portion. The coating fixing portion is fixed to the coating by the resin filled in the joint portion and guided to the gap.

7 Claims, 10 Drawing Sheets

TERMINAL-EQUIPPED ELECTRIC WIRE

CROSS-REFERENCES TO RELATED APPLICATIONS

This application is based on and claims priority from Japanese Patent Application No. 2018-009948 filed on Jan. 24, 2018, the entire contents of which are incorporated herein by reference.

FIELD

One or more embodiments of the present invention relate to a terminal-equipped electric wire, which includes a terminal fitting connected to an end portion of the electric wire.

BACKGROUND

A terminal-equipped electric wire has an end portion to which a terminal fitting including a core wire crimp portion crimped to a core wire of an electric wire and a coating crimp portion crimped to a coating portion covering the core wire is connected, and is known to suppress corrosion of the core wire by applying a resin to hermetically cover the core wire and a part of the terminal fitting (for example, see JP-A-2010-108828 and JP-A-2016-181387).

SUMMARY

The terminal-equipped electric wire having the above structure can suppress corrosion of the core wire by coating a resin on a joint portion between the core wire crimp portion and the coating crimp portion, as well as on an end portion of the core wire protruding from the core wire crimp portion.

However, when an external force such as a tensile force, an impact force, etc. is applied to the electric wire, the coating crimped in the coating crimp portion may be deformed and may peel off from the resin, which may result in degradation in a waterproof performance.

One or more embodiments of the present invention have been made in consideration of the above-described circumstances, and an object thereof is to provide a terminal-equipped electric wire having an excellent corrosion-resistance capable of maintaining an excellent waterproof performance even when an external force is applied to the electric wire.

In order to achieve the above-described object, the features of the terminal-equipped electric wire according to one or embodiments of the present invention will be simply summarized as the following (1) to (7).

(1) A terminal-equipped electric wire including:

an electric wire including a core wire covered with a coating; and a terminal fitting connected to an end portion of the electric wire in which the core wire is exposed, wherein the terminal fitting includes:

a core wire crimp portion crimped to the core wire to crimp the core wire;

a coating fixing portion surrounding the coating with a first gap between the coating fixing portion and the coating; and a joint portion provided between the core wire crimp portion and the coating fixing portion such that the core wire extending from a coating fixing portion side towards the core wire crimp portion passes through the joint portion, wherein the joint portion is sealed by a resin that is filled to surround an entire circumference of the core wire in the joint portion, and wherein the coating fixing portion is fixed to the coating by the resin that is filled in the joint portion and guided to the first gap between the coating fixing portion and the coating.

(2) The terminal-equipped electric wire according to (1), wherein a following relation is satisfied:

$$Da > Db + 2T$$

where:

Da is an outer diameter of the coating fixing portion,

Db is an outer diameter of the electric wire, and

T is a thickness of the terminal fitting.

(3) The terminal-equipped electric wire according to (1) or (2), wherein an entire circumference of the coating is fixed to the coating fixing portion by the resin.

(4) The terminal-equipped electric wire according to any one of (1) to (3), wherein an end portion of the coating fixing portion opposite to the joint portion is covered by the resin escaping from the first gap between the coating and the coating fixing portion.

(5) The terminal-equipped electric wire according to any one of (1) to (4), wherein the joint portion has rising portions extending from the core wire crimp portion and the coating fixing portion and provided at an opposite sides of the joint portion, and wherein the resin is filled in a second gap formed between the core wire and the rising portions in a planar view.

(6) The terminal-equipped electric wire according to any one of (1) to (5), wherein the resin filled in the joint portion penetrates into the first gap between the coating fixing portion and the coating without being attached to an outer circumference of the coating fixing portion.

(7) The terminal-equipped electric wire according to any one of (1) to (6), wherein the core wire is formed of aluminum or an aluminum alloy.

According to the terminal-equipped electric wire according to (1), the joint portion is sealed by the resin filled to cover the core wire, and thus, corrosion of the core wire at the joint portion between the core wire crimp portion and the coating fixing portion can be suppressed. Further, the coating fixing portion is firmly fixed to the coating by the resin that is filled in the joint portion and guided to the gap between the coating fixing portion and the coating. Therefore, even when the external force such as the tensile force, the impact force, etc. is applied to the electric wire, the isolation of the coating from the resin can be prevented, and thus, an excellent waterproof performance can be maintained.

According to the terminal-equipped electric wire according to (2), the gap in which the resin is filled is securely provided around the coating of the electric wire on the coating fixing portion, whereby it is possible to ensure high adhesive force of the electric wire due to the resin.

According to the terminal-equipped electric wire according to (3), since the entire circumference of the coating of the electric wire is fixed to the coating fixing portion, high adhesive force with respect to the electric wire on the coating fixing portion 47 can be ensured.

According to the terminal-equipped electric wire according to (4), the joint portion in the coating fixing portion and the opposite end can be sealed by the resin, to thereby ensure high waterproof performance and the adhesive force. In addition, whether the resin filled in the joint portion is definitely filled in the gap between the coating and the coating fixing portion can be identified by checking the resin covering the end portion of the coating fixing portion.

According to the terminal-equipped electric wire according to (5), the resin is filled between the core wire in the joint portion and the rising portion. Since the resin is filled in the gap such that the resin securely penetrates into the lower portion of the core wire, permeability of the resin to the joint portion can be improved.

According to the terminal-equipped electric wire according to (6), since the resin is not attached to the outer circumference side of the coating fixing portion, an outer appearance of the coating fixing portion can be prevented from being increased due to the resin. In the above case, even when the terminal fitting is accommodated in a cavity with severe dimensional precision in a housing of a connector, the terminal fitting can be inserted and accommodated in the cavity without interfering with an internal wall of the cavity.

According to the terminal-equipped electric wire according to (7), the core wire formed of aluminum or an aluminum alloy that is highly demanded to have a corrosion-resistance is securely sealed in the joint portion of the terminal fitting, which enables water sealing. Also, galvanic corrosion that may occur when the terminal fitting includes a different metal from that of the core wire, such as copper, a copper alloy, etc., can be effectively prevented.

According to one or more embodiments of the present invention, it is possible to provide a terminal-equipped electric wire having an excellent corrosion-resistance capable of maintaining an excellent waterproof performance even when an external force is applied to the electric wire.

Hereinbefore, aspects of the present invention have been described simply. Further, by reading through the following mode to carry out the invention (hereinafter, referred to as an "embodiment") with reference to the accompanying drawings, details will be further clarified.

BRIEF DESCRIPTION OF DRAWINGS

FIGS. 1A and 1B are diagrams of a terminal-equipped electric wire according to an embodiment, wherein FIG. 1A is a perspective view of the terminal-equipped electric wire and FIG. 1B is a perspective view of an terminal-equipped electric wire having no resin;

FIGS. 3A and 3B are diagrams of a wire connection portion of a terminal fitting in a terminal-equipped electric wire, wherein FIG. 3A is a plan view and FIG. 3B is a cross-sectional view in a lengthwise direction;

DETAILED DESCRIPTION

Figure 1A:
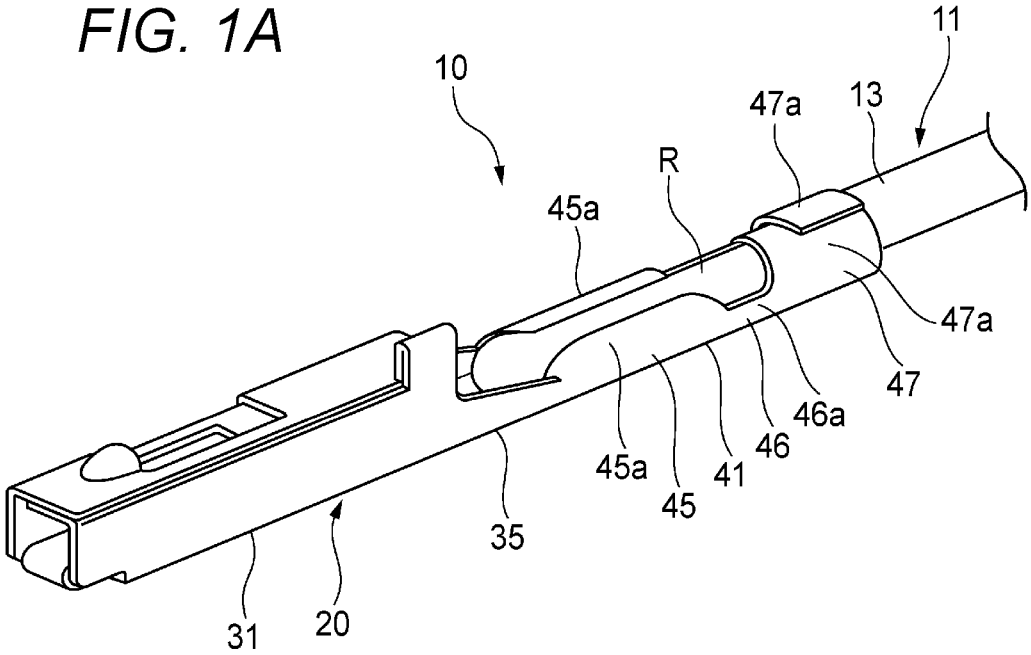

Hereinafter, an embodiment according to the present invention will be described with reference to the drawing.

Figure 1B:
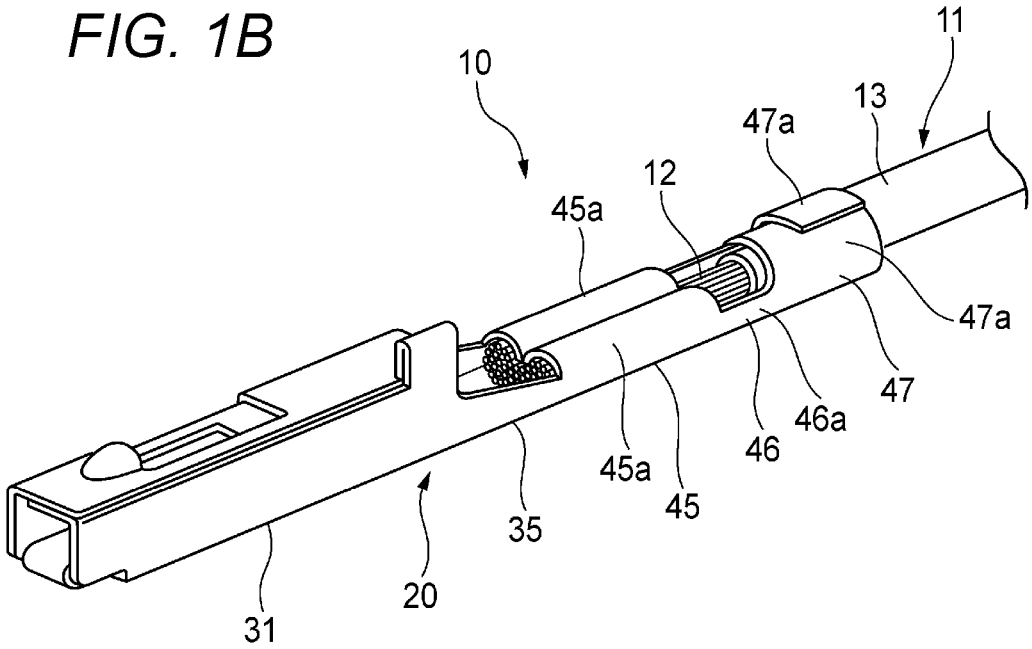
Figure 2:
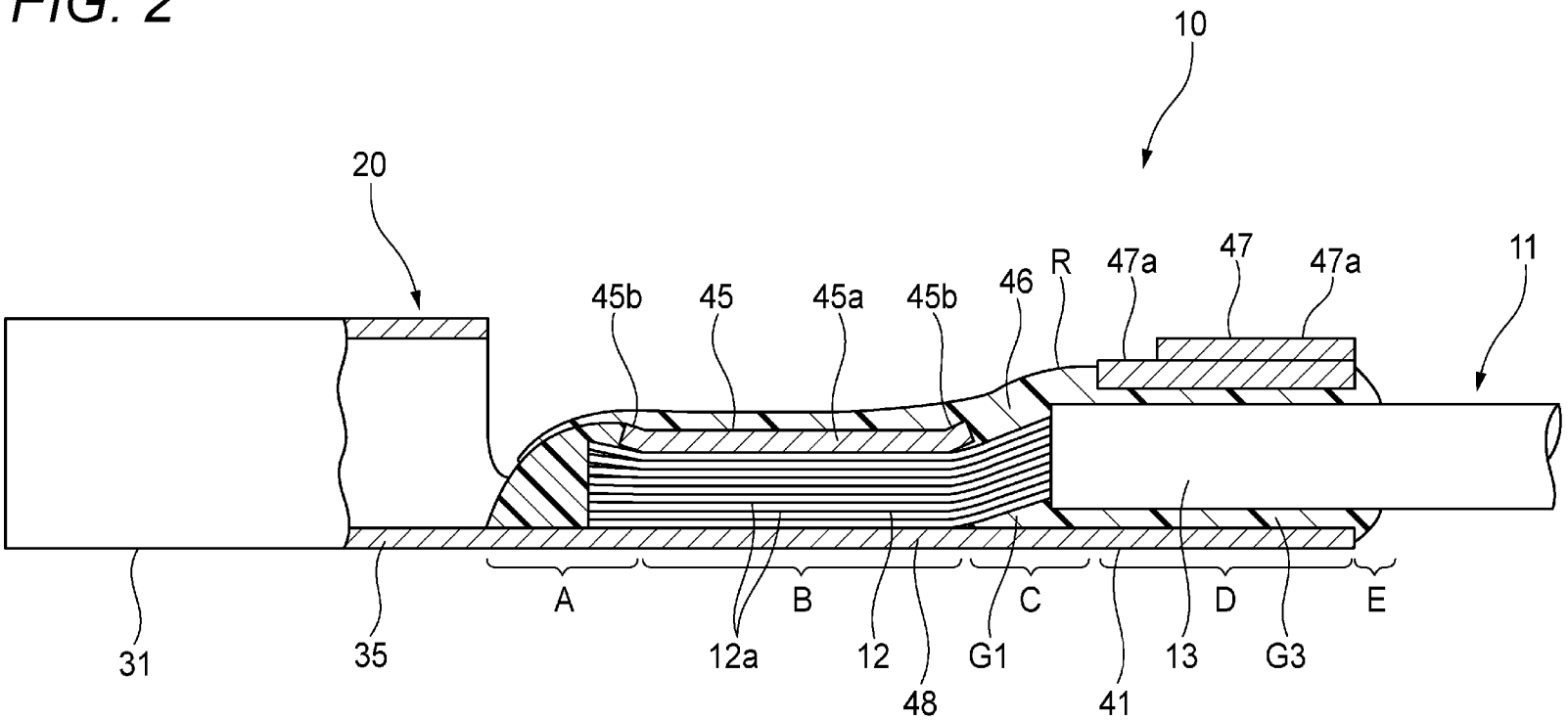
FIG. 2 is a cross-sectional view of a terminal-equipped electric wire in a lengthwise direction.

FIGS. 1A and 1B are diagrams of a terminal-equipped electric wire according to an embodiment, wherein FIG. 1A is a perspective view of the terminal-equipped electric wire and FIG. 1B is a perspective view of a terminal-equipped electric wire having no resin. FIG. 2 is a cross-sectional view of the terminal-equipped electric wire in a lengthwise direction.

As shown in FIGS. 1A and 1B and FIG. 2, a terminal-equipped electric wire 10 according to the present embodiment includes an electric wire 11 and a terminal fitting 20. The terminal fitting 20 is electrically connected to an end portion of the electric wire 11. The terminal-equipped electric wire 10 constitutes a wire harness arranged in, for example, a vehicle such as an automobile.

The electric wire 11 is an insulated electric wire including a core wire 12 and a coating 13 made of a resin covering the core wire 12. The core wire 12 is made of aluminum or an aluminum alloy, and is formed by twisting a plurality of strands 12*a*. When the core wire 12 of the electric wire 11 is made of aluminum or an aluminum alloy, the terminal-equipped electric wire 10 is reduced in weight, and the wire harness including the terminal-equipped electric wire 10 is also reduced in weight. The terminal-equipped electric wire 10 reduced in weight is properly used particularly in a vehicle such as an electric automobile, a hybrid automobile, or the like, which frequently uses the wire harness.

The terminal fitting 20 includes an electric connection portion 31 on a front portion thereof, and a wire connection portion 41 on a rear portion thereof. The electric connection portion 31 and the wire connection portion 41 are connected to each other via a connector 35.

The terminal fitting 20 is formed by performing a pressing (punching process and bending process) on a metal plate including a conductive metal material. The terminal fitting 20 is formed by using, for example, a metal plate made of copper or a copper alloy as a base material.

The electric connection portion 31 is formed as a cylindrical shape with a tip portion opened, and the electric connection portion 31 is electrically connected to a connection counterpart when a tab of a terminal fitting in the connection counterpart is inserted to the opening.

Figure 3A:
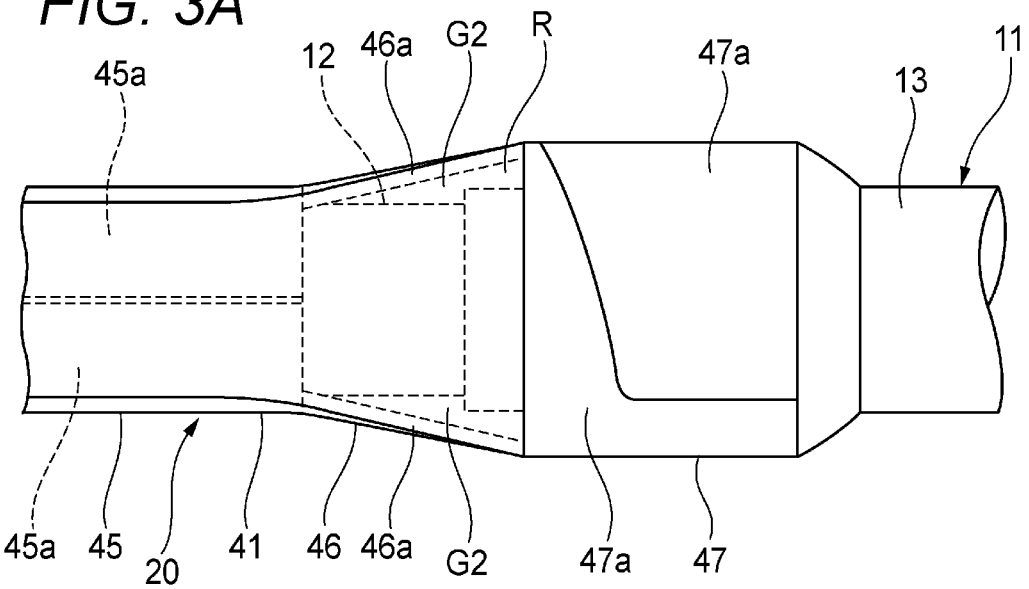
Figure 3B:
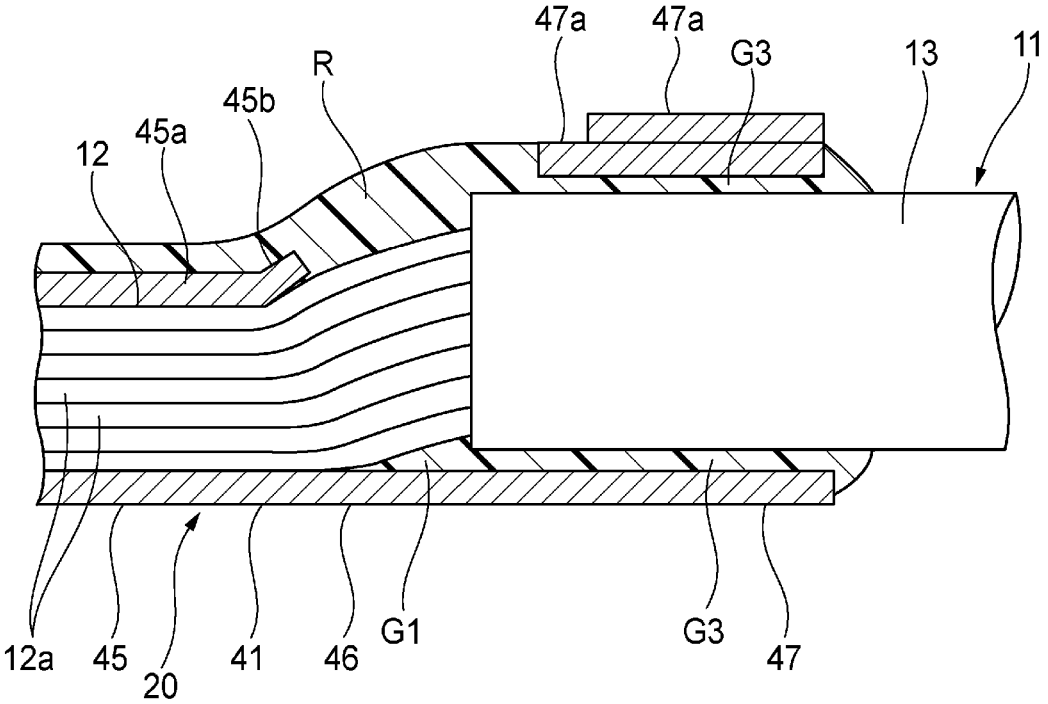

FIGS. 3A and 3B are diagrams of a wire connection portion of a terminal fitting in a terminal-equipped electric wire, wherein FIG. 3A is a plan view and FIG. 3B is a cross-sectional view in a lengthwise direction. As shown in FIGS. 3A and 3B, an end portion of the electric wire 11, from which the core wire 12 is exposed, is electrically connected to the wire connection portion 41. The wire connection portion 41 includes a core wire crimp portion 45, a joint portion 46, and a coating fixing portion 47 sequentially from a side of the electric connection portion 31.

The core wire crimp portion 45 includes a pair of core wire crimping pieces 45*a* and the coating fixing portion 47 includes a pair of coating fixing pieces 47*a*. The joint portion 46 is a portion connecting the core wire crimp portion 45 and the coating fixing portion 47 to each other, and includes rising portions 46*a* at opposite sides thereof for connecting the core wire crimping pieces 45*a* of the core wire crimp portion 45 and the coating fixing pieces 47*a* of the coating fixing portion 47 to each other. The core wire crimp portion 45, the joint portion 46, and the coating fixing portion 47 are connected to one another via a bottom plate portion 48.

The core wire crimping pieces 45*a* are crimped from opposite sides of the core wire crimp portion 45. Then the core wire crimp portion 45 is crimped and electrically connected to the core wire 12 of the electric wire 11. The core wire 12 is crimped and fixed to the core wire crimp portion 45 in a state where the tip portion of the core wire 12 slightly protrudes towards the electric connection portion 31 more than the core wire crimp portion 45. The core wire crimp portion 45 includes bell mouth portions 45*b* gradually expanding respectively at an end portion on the side of the electric connection portion 31 and an end portion on the side of the joint portion 46, and thus, the core wire crimping piece 45*a* is prevented from biting into the core wire 12.

The core wire 12 extending from the coating 13 of the electric wire 11 to the core wire crimp portion 45 passes through the joint portion 46. Also, in the joint portion 46, an end portion of the coating 13 protrudes slightly from the coating fixing portion 47. In the joint portion 46, a gap G1 is provided between the core wire 12 and the bottom plate portion 48 (see FIG. 3B). Also, in the joint portion 46, a gap G2 is provided between the core wire 12 and each of the rising portions 46*a* in a planar view (see FIG. 3A).

In the coating fixing portion 47, the coating fixing piece 47*a* is bent so as to wrap around a portion of the coating 13 at the end portion of the electric wire 11 and is crimped such that respective end portions overlap each other. The coating fixing piece 47*a* of the coating fixing portion 47 is crimped in a state where a gap G3 is formed with respect to the coating 13 of the electric wire 11.

As shown in FIG. 2, in the wire connection portion 41, the core wire 12 is sealed and waterproofed by a resin R. The resin R includes an ultraviolet ray (UV)-curable resin, and is applied through a lengthwise direction of the wire connection portion 41. In detail, the resin R is provided on a core wire protrusion region A closer to the side of the electric connection portion 31 than the core wire crimp portion 45 on the wire connection portion 41, a core wire crimp region B on which the core wire 12 is crimped by the core wire crimp portion 45, a joint region C where the core wire 12 passes through the joint portion 46, a coating fixing region D where the coating fixing piece 47*a* is crimped around the portion of the coating 13 as the gap G3 is interposed therebetween, and a coating region E at a side of a rear end of the coating fixing portion 47.

Figure 4:
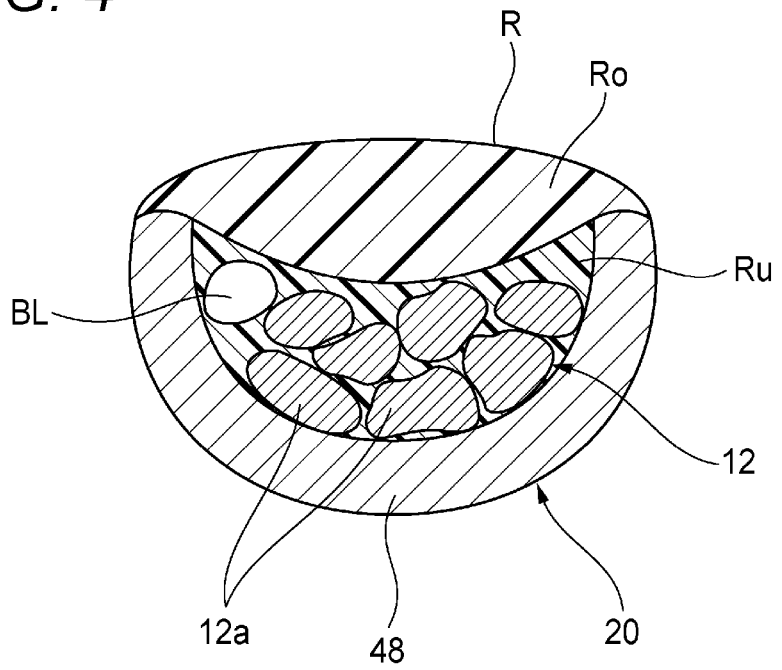
FIG. 4 is a cross-sectional view of a core wire protrusion region of a terminal-equipped electric wire.

FIG. 4 is a cross-sectional view of a core wire protrusion region of a terminal-equipped electric wire.

As shown in FIG. 4, in the core wire protrusion region A, the tip portion of the core wire 12 protruding from the core wire crimp portion 45 is covered by the resin R. In the core wire protrusion region A, the resin R covering the core wire 12 includes a lower layer portion Ru including a first resin R1 and an upper layer portion Ro including a second resin R2.

In the core wire crimp region B, an abutting portion of the core wire crimping piece 45*a* is covered by the resin R on an upper portion of the core wire crimp portion 45 that crimps the core wire 12.

Figure 5:
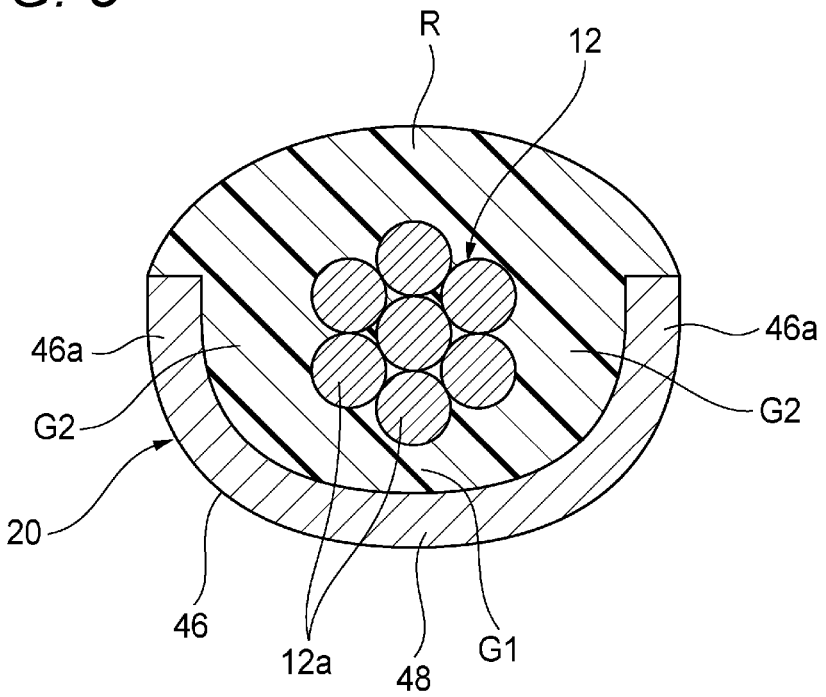
FIG. 5 is a cross-sectional view of a joint region in a terminal-equipped electric wire.

FIG. 5 is a cross-sectional view of a joint region in a terminal-equipped electric wire.

As shown in FIG. 5, in the joint region C, the joint portion 46 is buried by the resin R so as to seal the core wire 12. In addition, in the joint region C, the resin R is filled in the gap G1 between the bottom plate portion 48 and the core wire 12, the gap G2 between the core wire 12 and the rising portion 46*a*, on an upper portion of the core wire 12, and among the strands 12*a* constituting the core wire 12. Therefore, in the joint region C, the core wire 12 is covered with the resin R.

Figure 6:
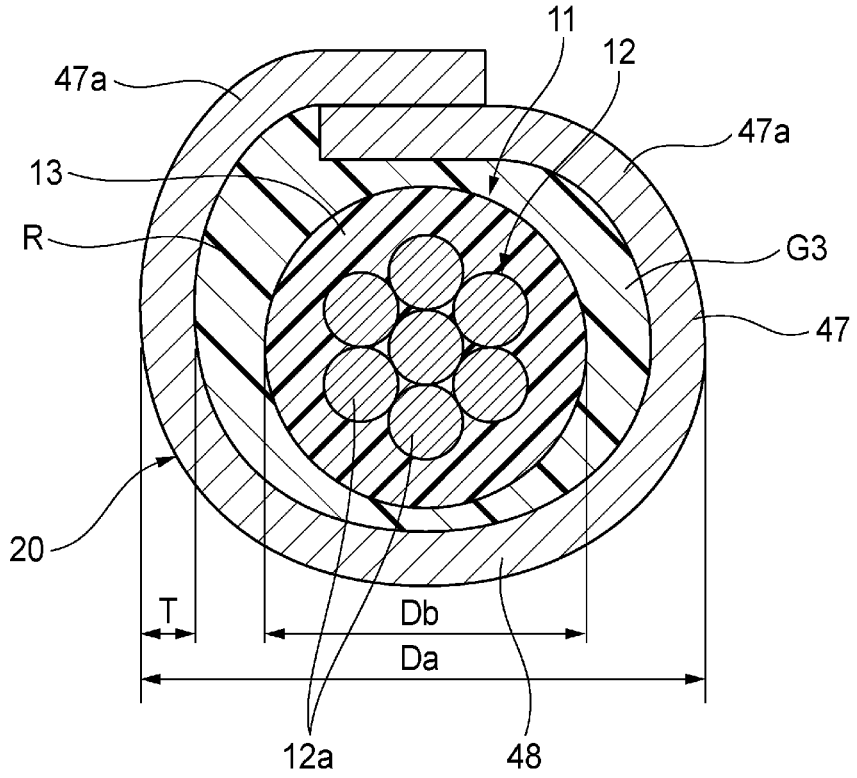
FIG. 6 is a cross-sectional view of a coating fixing region in a terminal-equipped electric wire.

FIG. 6 is a cross-sectional view of a coating fixing region in a terminal-equipped electric wire.

As shown in FIG. 6, in the coating fixing region D, the gap G3 between an outer circumference of the coating 13 and an inner circumference of the coating fixing piece 47*a* of the coating fixing portion 47 is buried by the resin R. Thus, in the coating fixing region D, the coating 13 of the electric wire 11 and the coating fixing portion 47 are fixed by the resin R over an entire circumference and a longitudinal direction. In the coating fixing portion 47, the resin R filled in the joint portion 46 is not attached to the outer circumference, but penetrates into the gap G3 between the outer circumference and the coating 13, and thus, the gap G3 is buried by the resin R.

In the coating fixing region D, when an outer diameter of the coating fixing portion 47 is Da, an outer diameter of the electric wire 11 is Db, and a thickness of the terminal fitting 20 is T, formula (1) below is satisfied.

$$Da > Db + 2T \quad (1)$$

In the coating region E, a rear end of the coating fixing portion 47 is buried by the resin R over the entire circumference.

The above terminal-equipped electric wire 10 accommodates the terminal fitting 20 when the terminal fitting 20 is inserted to a cavity of a housing constituting a connector. In addition, by joining connectors to each other, a tab of a terminal fitting of a connecting counterpart is inserted to the opening of the electric connection portion 31 to be electrically connected.

Next, a method of manufacturing the terminal-equipped electric wire 10 will be described below.

(1) Terminal Connection Process

A terminal process for removing the coating 13 at the end portion of the electric wire 12 to expose the core wire 12 is performed.

Then, the end portion of the electric wire 11, on which the terminal process is performed, is arranged on the wire connection portion 41 of the terminal fitting 20, and the core wire crimping piece 45*a* of the core wire crimp portion 45 and the coating fixing piece 47*a* of the coating fixing portion 47 are crimped. As a result, the core wire 12 of the electric wire 11 is crimp-connected to the core wire crimp portion 45. Also, the coating fixing piece 47*a* in the coating fixing portion 47 is crimped to be enclosed such that the gap G3 is formed with respect to the coating 13 of the electric wire 11.

(2) Sealing Process

The resin R is applied to the core wire protrusion region A, the core wire crimp region B, the joint region C, the coating fixing region D, and the coating region E on the wire connection portion 41 of the terminal fitting 20 connected to the end portion of the electric wire 11, so as to seal the core wire 12. In the sealing process, the first resin R1 and the second resin R2 including the same UV-curable resin are applied.

Next, the sealing process will be described in detail with reference to the flowchart of FIG. 7.

Figure 7:
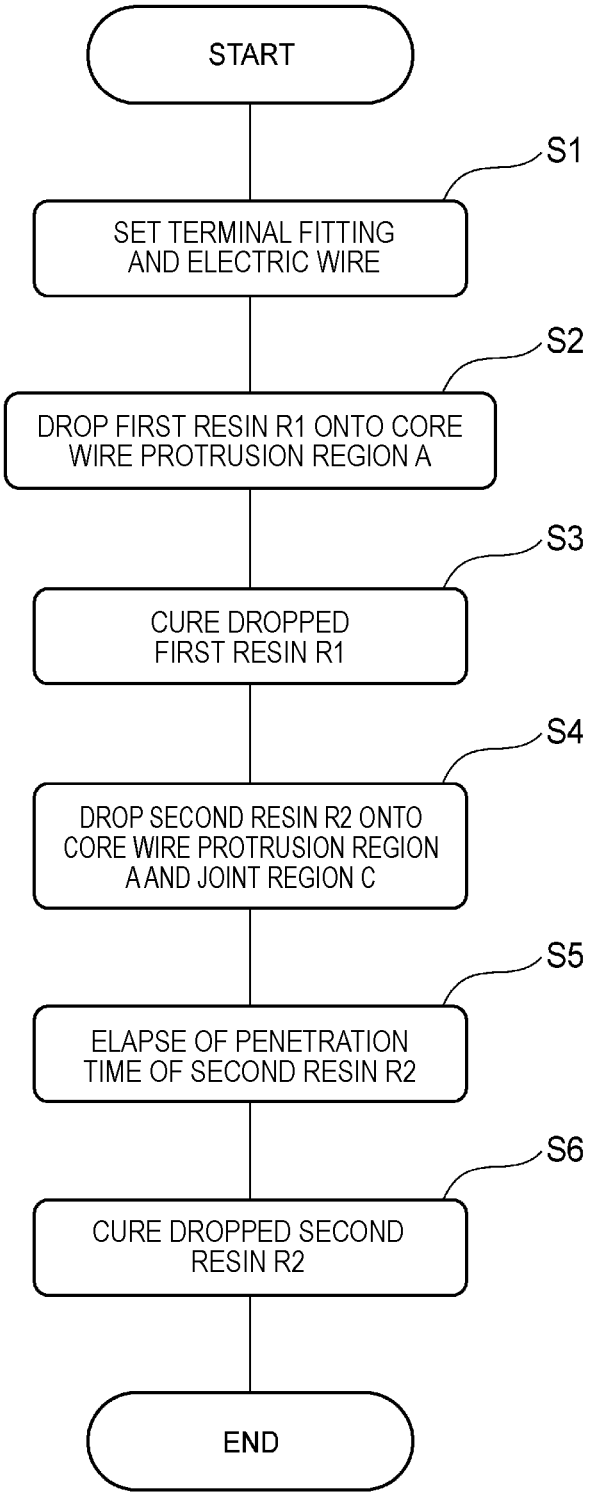
FIG. 7 is a flowchart illustrating a treatment in a process of forming a resin portion.

FIG. 7 is a flowchart illustrating a treatment in a process of forming a resin portion. FIGS. 8A to 8D are diagrams illustrating each treatment in a process of forming a resin portion, and are schematic cross-sectional views in a lengthwise direction of a terminal-equipped electric wire. FIG. 9 is a diagram illustrating positioning of an electric wire with respect to a terminal fitting, as seen from a rear end of the terminal fitting viewed in a sectional view.

Process of Applying the First Resin

Figure 8A:
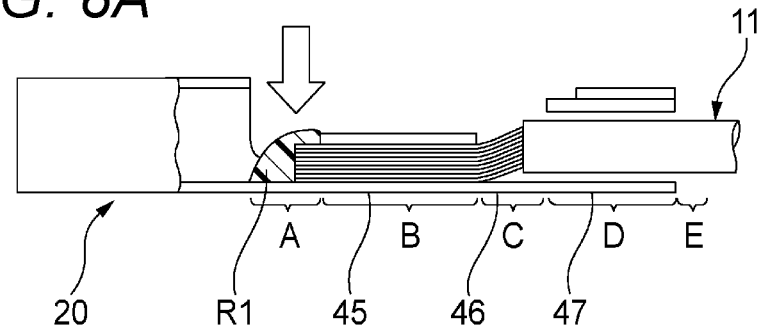
FIGS. 8A to 8D are diagrams illustrating each treatment in a process of forming a resin portion, and are schematic cross-sectional views in a lengthwise direction of a terminal-equipped electric wire.
Figure 9:
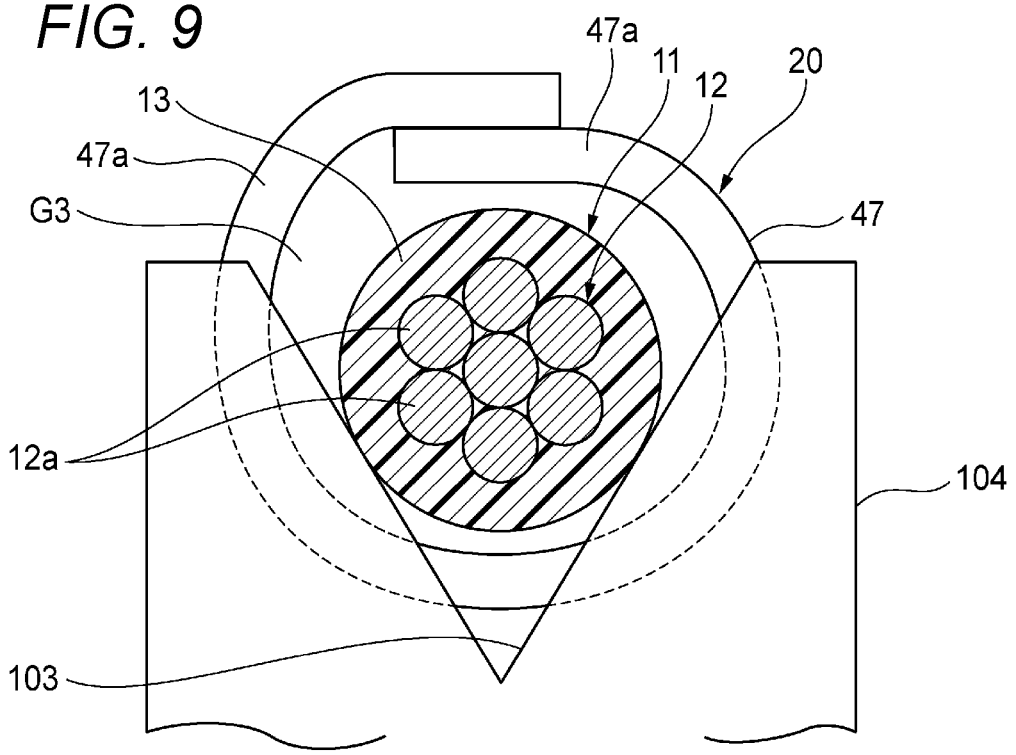
FIG. 9 is a diagram for describing positioning of an electric wire with respect to a terminal fitting, as seen from a rear end of the terminal fitting viewed in a sectional view.

The terminal fitting 20 connected to the end portion of the electric wire 11 is set in an application device for applying the resin (step S1), and then as shown in FIG. 8A, the first resin R1, that is, the UV-curable resin is applied to the core wire protrusion region A (step S2). Application of the first resin R1 is performed by dropping the first resin R1 from an upper portion of the core wire protrusion region A through a nozzle. By dropping the first resin R1 onto the core wire protrusion region A, the tip portion of the core wire 12 protruding from the core wire crimp portion 45 is covered by the first resin R1 dropped in the core wire protrusion region A.

Process of Curing the First Resin

Figure 8B:
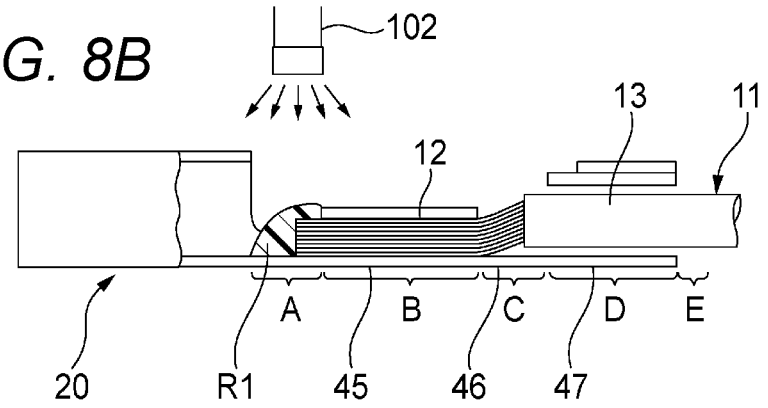

As shown in FIG. 8B, UV ray is irradiated by a UV irradiator 102 to the first resin R1 that has been applied through the first resin applying process, so as to cure the first resin (step S3). As a result, on the core wire protrusion region A, the first resin R1 covering the tip portion of the core wire 12 is rapidly cured to form the lower layer portion Ru of the resin R.

Process of Applying the Second Resin

Figure 8C:
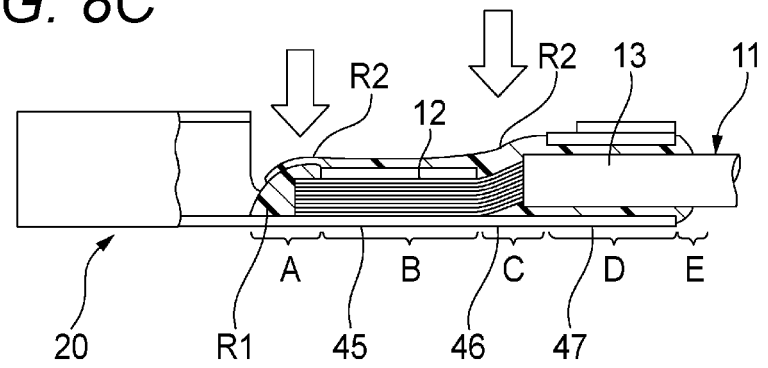

As shown in FIG. 8C, the second resin R2, that is, the UV-curable resin, is applied to the core protrusion region A, the core wire crimp region B, the joint region C, the coating fixing region D, and the coating region E (step S4).

Application of the second resin R2 is performed by dropping the second resin R2 from upper portions of the core wire protrusion region A and the joint region C through the nozzle. That is, the second resin R2 is firstly dropped onto the joint region C, and then dropped onto the core wire protrusion region A. An amount of the second resin R2 dropping onto the core wire protrusion region A is less than that of the first resin R1 that has been dropped through the first resin application process.

As shown in FIG. 9, during the process of applying the second resin, the electric wire 11 is supported by a jig 104 including an electric wire supporting recess 103 that has a V-shape widening upward near the terminal fitting 20. Thus, a center of the electric wire 11 is positioned at a center of the coating fixing portion 47 that is crimped so as to wrap around the electric wire 11.

Resin Penetration Process

In order to penetrate the second resin R2 dropped onto the joint region C during the process of applying the second resin, a predetermined penetration time is allowed to elapse (step S5). The penetration time in the resin penetration process is determined according to viscosity of the second resin R2 or the number of strands 12*a* included in the core wire 12.

The second resin R2 dropped on the joint region C penetrates among the strands 12*a* of the core wire 12 as the penetration time elapses, and flows into the gap G2 between the core wire 12 and the rising portion 46*a* and the gap G1 between the bottom plate portion 48 and the core wire 12. Therefore, in the joint region C, the core wire 12 is covered by the second resin R2.

In addition, the second resin R2 dropped onto the joint region C enters the gap G3 between the outer circumference of the coating 13 and the inner circumference of the coating fixing portion 47 as the penetration time elapses, and then penetrates into the rear end portion due to a capillary phenomenon. As a result, in the coating fixing region D, the second resin R2 is filled in the gap G3 between the coating 13 of the electric wire 11 and the coating fixing portion 47 without generating a gap. In addition, the second resin R2 filled in the gap G3 in the coating fixing region D partially escapes from a rear end of the coating fixing portion 47. As a result, in the coating region E, the second resin R2 is applied to the rear end side of the coating fixing portion 47 throughout the entire circumference. In the coating fixing region D, whether the second resin R2 is filled in the gap G3 between the coating 13 of the electric wire 11 and the coating fixing portion 47 without space can be easily identified by visually identifying the second resin R2 escaping over the entire circumference in the coating region E.

The second resin R2 dropped on the joint region C is partially guided towards the core wire protrusion region A along an abutting portion of the core wire crimping piece 45*a* in the core wire crimp portion 45, due to the capillary effect. Then, the abutting portion of the core wire crimping piece 45*a* in the core wire crimp region B is covered by the second resin R2. Further, the second resin R2 guided towards the core wire protrusion region A along the abutting portion of the core wire crimping piece 45*a* is blocked by the lower layer portion Ru formed by the second resin R1 that is cured in the core wire protrusion region A.

Process of Curing the Second Resin

Figure 8D:
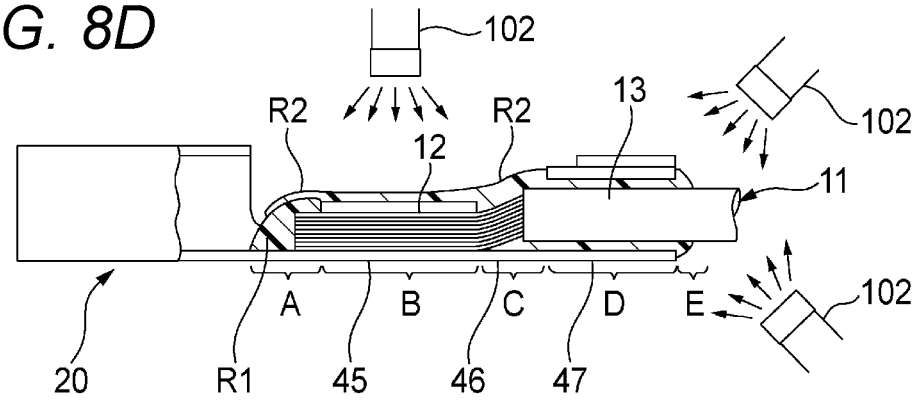

As shown in FIG. 8D, the UV ray is thoroughly irradiated by a plurality of UV irradiators 102 onto the second resin R2 that is applied through the second resin application process and then penetrates into each part through the resin penetration process, so as to cure the second resin R2 (step S6).

As a result, in the core wire protrusion region A, the second resin R2 dropped on the lower layer portion Ru is cured to form the upper layer portion Ro. When the upper layer portion Ro is formed, the core wire 12 is securely covered by the lower layer portion Ru and the upper layer portion Ro in the core wire protrusion region A. Here, in the core wire protrusion region A, since the strands 12*a* included in the core wire 12 are in dispersed state, an air bubble BL may generate among the strands 12*a* of the core wire 12 when the first resin R1 is dropped to form the lower layer portion Ru, to thereby degrade the waterproof performance. However, by forming the upper layer portion Ro on the lower layer portion Ru, the lower layer portion Ru is covered by the upper layer portion Ro with the air bubble BL, and thus, a definite waterproof property of the core wire protrusion region A can be ensured.

In the joint region C, the second resin R2 filled in the gap G1 between the bottom plate portion 48 and the core wire 12, the gap G2 between the core wire 12 and the rising portion 46*a*, on the upper portion of the core wire 12, and among the strands 12*a* constituting the core wire 12 is cured, and thus, the core wire 12 is covered by the cured second resin R2.

In the coating fixing region D, since the second resin R2 filled in the gap G3 between the outer circumference of the coating 13 and the inner circumference of the coating fixing portion 47 is cured, the coating 13 of the electric wire 11 and the coating fixing portion 47 are firmly fixed by the cured second resin R2 throughout the entire circumference and in the lengthwise direction.

In the coating region E, the second resin R2 escaping over the entire circumference is cured at the rear end of the coating fixing portion 47, and thus, the rear end of the coating fixing portion 47 and the coating 13 are covered throughout the entire circumference.

The terminal-equipped electric wire 10, in which the wire connection portion 41 of the terminal fitting 20 connected to the end portion of the electric wire 11 is covered by the resin R (the first resin R1 and the second resin R2), can be obtained by performing the above-described processes.

As described above, according to the terminal-equipped electric wire 10 of the present embodiment, the joint portion 46 is sealed by the resin R filled to cover the core wire 12, and thus, corrosion of the core wire 12 at the joint portion 46 between the core wire crimp portion 45 and the coating fixing portion 47 can be suppressed.

Figure 10:
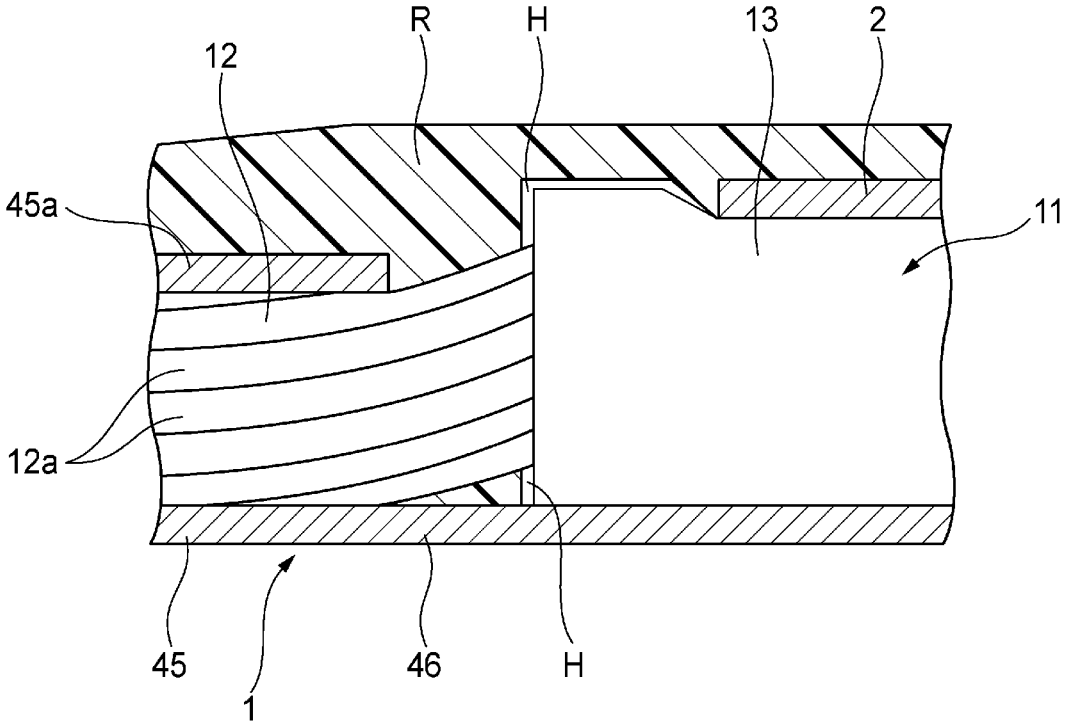
FIG. 10 is a schematic cross-sectional view of a part in a terminal-equipped electric wire in a lengthwise direction, according to a reference example.

Here, as shown in FIG. 10, in a terminal fitting 1 in which a portion of the coating 13 of the electric wire 11 is crimped by a crimping piece 2 to be mechanically fixed, when an external force such as a tensile force, an impact force, etc. is applied to the electric wire 11, the coating 13 that is crimped by the crimping piece 2 may be deformed and may peel off from the resin R (see reference numeral H in FIG. 10) to thereby degrade the waterproof performance On the other hand, in the terminal-equipped electric wire 10 according to the present embodiment, the coating fixing portion 47 is firmly fixed to the coating 13 by the resin R that is filled in the joint portion 46 and guided to the gap G3 between the coating fixing portion 47 and the coating 13. Therefore, even when the external force such as the tensile force, the impact force, etc. is applied to the electric wire 11, the isolation of the coating 13 from the resin R can be prevented, and thus, an excellent waterproof performance can be maintained.

In particular, because a formula Da>Db+2T is satisfied when the outer diameter of the coating fixing portion 47 is Da, the outer diameter of the electric wire 11 is Db, and the thickness of the terminal fitting 20 is T, the gap G3 in which the resin R is filled is securely provided around the coating 13 of the electric wire 11 on the coating fixing portion 47, whereby it is possible to ensure high adhesive force of the electric wire 11 due to the resin R.

Since the entire circumference of the coating 13 of the electric wire 11 is fixed to the coating fixing portion 47, high adhesive force with respect to the electric wire 11 on the coating fixing portion 47 can be ensured.

Moreover, an end portion in the coating fixing portion 47 opposite to the joint portion 46 is covered by the resin R escaping from the gap G3 between the coating 13 and the coating fixing portion 47. Therefore, the joint portion 46 in the coating fixing portion 47 and the opposite end can be sealed by the resin, to thereby ensure high waterproof performance and the adhesive force. In addition, whether the resin R filled in the joint portion 46 is definitely filled in the gap G3 between the coating 13 and the coating fixing portion 47 can be identified by checking the resin R covering the end portion of the coating fixing portion 47.

The resin R is filled between the core wire 12 in the joint portion 46 and the rising portion 46*a*. Since the resin R is filled in the gap G2 such that the resin R securely penetrates into the lower portion of the core wire 12, permeability of the resin R to the joint portion 46 can be improved.

In particular, since the coating fixing portion 47 is crimped to have the gap G3 with respect to the coating 13 of the electric wire 11 and to have a large outer diameter, the gap G2 between the core wire 12 and the rising portion 46*a* becomes greater as compared with a case in which the portion of the coating 13 is crimped to be fixed. As a result, the resin R filled in the gap G2 can smoothly penetrate into the gap G1, in which the resin R would have been difficult to be filled, between the core wire 12 and the bottom plate portion 48, and thus an excellent waterproof performance can be ensured at the lower portion of the core wire 12.

In addition, since the resin R is not attached to the outer circumference side of the coating fixing portion 47, an outer appearance of the coating fixing portion 47 can be prevented from being increased due to the resin R. In the above case, even when the terminal fitting 20 is accommodated in a cavity with severe dimensional precision in a housing of a connector, the terminal fitting 20 can be inserted and accommodated in the cavity without interfering with an internal wall of the cavity.

According to the present embodiment, the core wire 12 formed of aluminum or an aluminum alloy that is highly demanded to have a corrosion-resistance is securely sealed in the joint portion 46 of the terminal fitting 20, which enables water sealing. Also, galvanic corrosion that may occur when the terminal fitting 20 includes a different metal from that of the core wire 12, such as copper, a copper alloy, etc., can be effectively prevented.

In the above embodiment, a structure in which the coating fixing pieces 47*a* partially overlap each other to enclose the electric wire 11 is exemplarily shown as the coating fixing portion 47; however, a shape of the coating fixing portion 47 is not limited to the example in the above embodiment, provided that the gap G3 may be generated between the portion of the coating 13 of the electric wire 11 and the coating fixing portion 47. In addition, the coating fixing portion 47 may be partially in contact with the coating 13 of the electric wire 11. Alternatively, end portions of the coating fixing pieces 47*a* in the coating fixing portion 47 may have a gap therebetween without contacting each other.

Figure 11A:
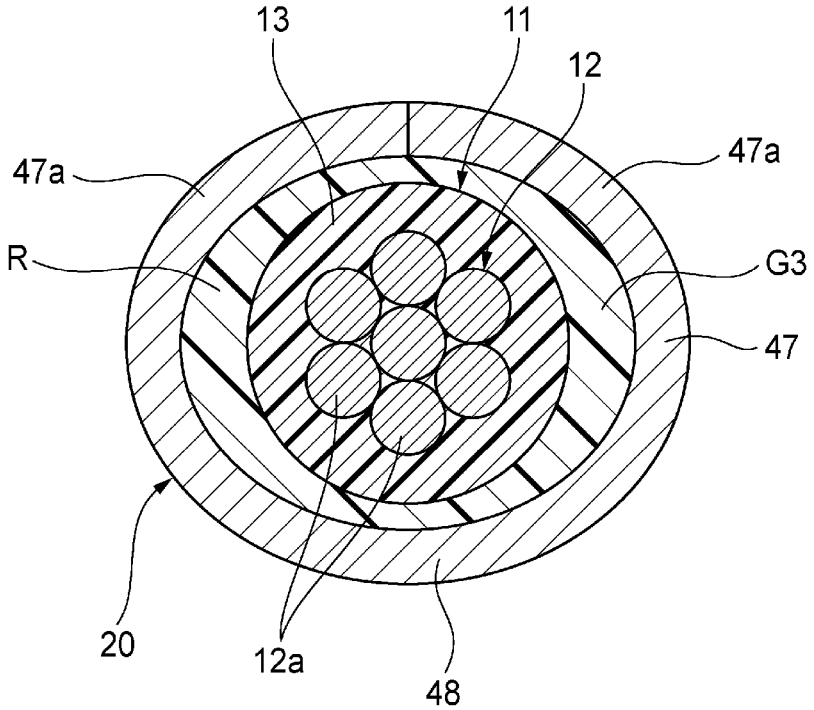
FIGS. 11A and 11B are diagrams illustrating a modified example of a coating fixing portion, and are cross-sectional views of a coating fixing region in a terminal-equipped electric wire.
Figure 11B:
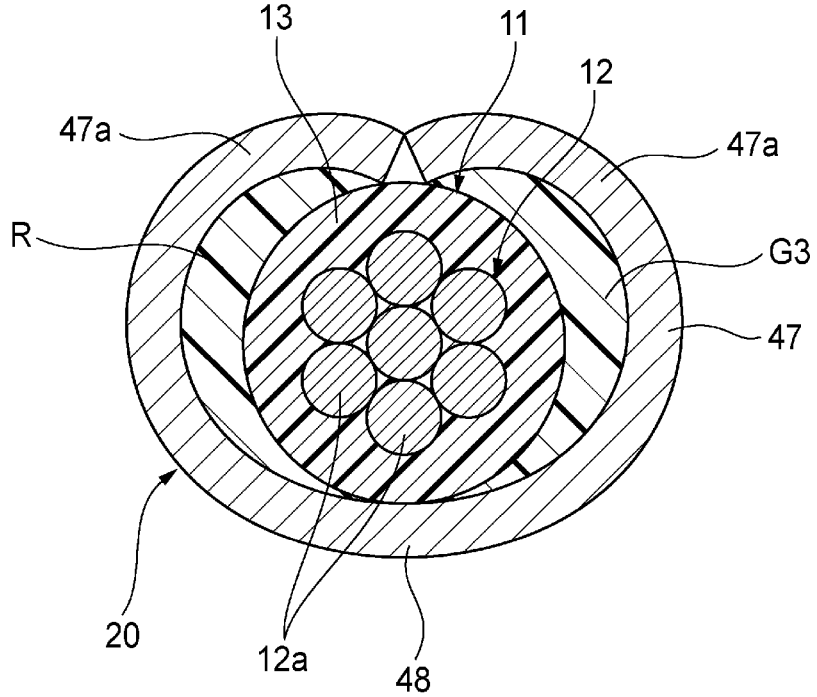

For example, as shown in FIG. 11A, the coating fixing portion 47 may be formed in such a shape that the end portions of the coating fixing pieces 47*a* abut on each other to surround the electric wire 11, and as shown in FIG. 11B, the end portion of the coating fixing piece 47*a* may be wound around the electric wire 11 to surround the electric wire 11.

The terminal fitting 20 may not only be inserted to a cavity formed in the housing of the connector, but may be also directly connected to a connecting counterpart.

Figure 12:
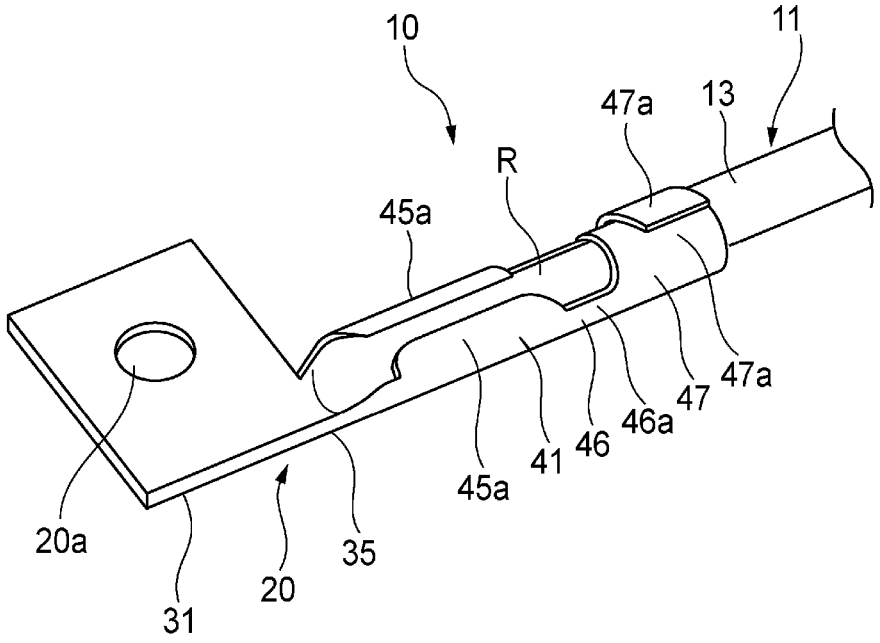
FIG. 12 is a perspective view of a terminal-equipped electric wire for illustrating a modified example of a terminal fitting.

In the above embodiment, an example that the terminal fitting 20 has the electric connection portion 31 of a box-shape in which a tab of a terminal fitting of a counterpart is inserted is shown, and the electric connection portion 31 of the terminal fitting 20 is not limited to the above example. For example, as shown in FIG. 12, a coupling portion having a bolt hole 20*a* for coupling to the connection counterpart may be provided.

The resin R (the first resin R1 and the second resin R2) is not limited to the UV-curable resin, but may be a thermosetting resin. In this case, in the first resin curing process and the second resin curing process, the applied resin R (the first resin R1 and the second resin R2) is heated to be cured.

The core wire 12 of the electric wire 11 is not limited to the core wire 12 formed of aluminum or an aluminum alloy, but the core wire 12 formed of copper or a copper alloy may be used. In the electric wire 11 having the core wire 12 formed of the aluminum or the aluminum alloy, the galvanic corrosion that may occur when the terminal fitting 20 includes a different metal such as the copper or the copper alloy can be effectively suppressed by the resin R.

It should be noted that the present invention is not limited to the above-described embodiments, and various modifications are included. In addition, materials, shapes, sizes, the number, arrangement place, or the like of each component in the above-described embodiments are arbitrary and not limited as long as they can attain the present invention.

Herein, the features of the terminal-equipped electric wire according to one or embodiments of the present invention will be simply summarized as the following (1) to (7).

(1) A terminal-equipped electric wire (10) including:

an electric wire (11) including a core wire (12) covered with a coating (13); and a terminal fitting (20) connected to an end portion of the electric wire (11) in which the core wire (12) is exposed, wherein the terminal fitting (20) includes:

a core wire crimp portion (45) crimped to the core wire (12) to crimp the core wire (12);

a coating fixing portion (47) surrounding the coating (13) with a first gap (G3) between the coating fixing portion (47) and the coating (13); and a joint portion (46) provided between the core wire crimp portion (45) and the coating fixing portion (47) such that the core wire (12) extending from a coating fixing portion (47) side towards the core wire crimp portion (45) passes through the joint portion (46), wherein the joint portion (46) is sealed by a resin (R) that is filled to surround an entire circumference of the core wire (12) in the joint portion (46), and wherein the coating fixing portion (47) is fixed to the coating (13) by the resin (R) that is filled in the joint portion (46) and guided to the first gap (G3) between the coating fixing portion (47) and the coating (13).

(2) The terminal-equipped electric wire according to (1), wherein a following relation is satisfied:

$$Da>Db+2T$$

where:

Da is an outer diameter of the coating fixing portion (47),

Db is an outer diameter of the electric wire (11), and

T is a thickness of the terminal fitting (20).

(3) The terminal-equipped electric wire according to (1) or (2), wherein an entire circumference of the coating (13) is fixed to the coating fixing portion (47) by the resin (R).

(4) The terminal-equipped electric wire according to any one of (1) to (3), wherein an end portion of the coating fixing portion (47) opposite to the joint portion (46) is covered by the resin (R) escaping from the first gap (G3) between the coating (13) and the coating fixing portion (47).

(5) The terminal-equipped electric wire according to any one of (1) to (4), wherein the joint portion (46) has rising portions (46*a*) extending from the core wire crimp portion (45) and the coating fixing portion (47) and provided at an opposite sides of the joint portion (46), and wherein the resin (R) is filled in a second gap (G2) formed between the core wire (12) and the rising portions (46*a*) in a planar view.

(6) The terminal-equipped electric wire according to any one of (1) to (5), wherein the resin (R) filled in the joint portion (46) penetrates into the first gap (G3) between the coating fixing portion (47) and the coating (13) without being attached to an outer circumference of the coating fixing portion (47).

(7) The terminal-equipped electric wire according to any one of (1) to (6), wherein the core wire (12) is formed of aluminum or an aluminum alloy.

The invention claimed is:

1. A terminal-equipped electric wire comprising:

an electric wire comprising a core wire covered with a coating; and a terminal fitting connected to an end portion of the electric wire in which the core wire is exposed, wherein the terminal fitting comprises:

a core wire crimp portion crimped to the core wire to crimp the core wire;

a coating fixing portion surrounding the coating with a first gap between the coating fixing portion and the coating; and a joint portion provided between the core wire crimp portion and the coating fixing portion such that the core wire extending from a coating fixing portion side towards the core wire crimp portion passes through the joint portion, wherein the joint portion is sealed by a resin that is filled to surround an entire circumference of the core wire in the joint portion, and wherein the coating fixing portion is fixed to the coating by the resin that is filled in the joint portion and guided to the first gap between the coating fixing portion and the coating.

2. The terminal-equipped electric wire according to claim 1, wherein a following relation is satisfied:

$$Da>Db+2T$$

where:

Da is an outer diameter of the coating fixing portion,

Db is an outer diameter of the electric wire, and

T is a thickness of the terminal fitting.

3. The terminal-equipped electric wire according to claim 1, wherein an entire circumference of the coating is fixed to the coating fixing portion by the resin.

4. The terminal-equipped electric wire according to claim 1, wherein an end portion of the coating fixing portion opposite to the joint portion is covered by the resin escaping from the first gap between the coating and the coating fixing portion.

5. The terminal-equipped electric wire according to claim 1, wherein the joint portion has rising portions extending from the core wire crimp portion and the coating fixing portion and provided at an opposite sides of the joint portion, and wherein the resin is filled in a second gap formed between the core wire and the rising portions in a planar view.

6. The terminal-equipped electric wire according to claim 1, wherein the resin filled in the joint portion penetrates into the first gap between the coating fixing portion and the coating without being attached to an outer circumference of the coating fixing portion.

7. The terminal-equipped electric wire according to claim 1, wherein the core wire is formed of aluminum or an aluminum alloy.

* * * * *